United States Patent [19]

Pfeiffer et al.

[11] Patent Number: 4,966,293

[45] Date of Patent: Oct. 30, 1990

[54] TRANSPORT AND/OR STORAGE CONTAINER FOR LIQUIDS AND FINELY DIVIDED BULK SOLIDS

[75] Inventors: Pierre Pfeiffer, Drulingen; Benoit Cheval, Saverne; Paul Sigwalt, Drulingen, all of France

[73] Assignee: Sotralentz S.A., Drulingen, France

[21] Appl. No.: 417,965

[22] Filed: Oct. 6, 1989

[30] Foreign Application Priority Data

Oct. 8, 1988 [DE] Fed. Rep. of Germany ..... 3834280

[51] Int. Cl.[5] ..... B65D 87/00

[52] U.S. Cl. ..... 220/1.5; 220/19; 220/401; 206/386

[58] Field of Search ..... 220/1.5, 5 A, 19, 401, 220/402, 410; 206/386

[56] References Cited

U.S. PATENT DOCUMENTS

| | | | |
|---|---|---|---|
| 3,272,377 | 9/1966 | Schray | 220/19 |
| 4,090,633 | 5/1978 | Trubiano | 220/1.5 X |
| 4,106,626 | 8/1978 | Trubiano | 220/19 X |
| 4,157,609 | 6/1979 | Schutz | 220/462 X |
| 4,173,288 | 11/1979 | Schutz | 220/1.5 |
| 4,793,519 | 12/1988 | Voorhies, Jr. | 220/465 |
| 4,795,057 | 1/1989 | Jundels et al. | 220/1.5 X |
| 4,909,387 | 3/1990 | Schutz | 220/19 X |

*Primary Examiner*—Steven M. Pollard
*Attorney, Agent, or Firm*—Herbert Dubno

[57] ABSTRACT

A transport and storage container for flowable materials has an outer enclosure formed with a gridwork of vertical and horizontal bars which surround a plastic inner vessel. A pallet is formed by a similar gridwork and the supporting feet are at least in part formed by downwardly bent portions of the grid bars of the bent pallet which are connected to extensions of the vertical bars of the outer enclosure, e.g. by welding. The supporting foot may be bent from these portions or may be constituted by an angle member welded thereto and a reinforcing plate or sheet can be welded to the downwardly bent portions for greater stability.

20 Claims, 4 Drawing Sheets

TRANSPORT AND/OR STORAGE CONTAINER FOR LIQUIDS AND FINELY DIVIDED BULK SOLIDS

CROSS-REFERENCE TO RELATED APPLICATIONS

This application is related to the commonly assigned U.S. Pat. No. 4,817,811 issued Apr. 4, 1989 and copending application Ser. Nos. 07/228,903 filed Aug. 4, 1988, 07/285,901 filed Dec. 16, 1988, 07/267,414 filed Nov. 4, 1988 and 07/404,305 filed Sept. 7, 1989.

1. Field of the Invention

Our present invention relates to a transport and/or storage container for flowable materials, i.e. liquids or finely divided bulk solids which are likewise flowable and, more particularly, to a container for such purposes which comprises an outer supporting enclosure constituted of a gridwork of horizontal and vertical grid bars, and a supported inner vessel of a flexible synthetic resin, e.g. a blow molded thermoplastic foil.

Upon the filling of the inner vessel with the flowable material, the weight of that material causes the walls of the inner vessel to press against the lateral wall or walls and the floor formed by the gridwork of the outer enclosure so that flexible of the inner vessel is fully supported.

The floor of the outer enclosure may be provided on a pallet to allow the movement of the container by forklift truck or similar means. The term "pallet" is used herein to refer to any structure enabling a lifting unit, such as the fork of a forklift truck or pallet hoist or lifter to be engaged below the floor of the outer enclosure to lift the full, partially empty or empty container for transport, positioning or stacking.

2. Background of the Invention

The principles of containers having a cage-like outer enclosure and an inner vessel have been fully developed in the above-identified applications and are known in the art as well.

In general, such containers are used for the storage and transport of large volumes of the flowable material, say 1000 liters, and the bars of the gridwork are composed of steel or some other suitable material and can be of round or other cross-section.

The outer shell of the enclosure having one or more lateral walls, can be formed in one piece from a gridwork by a bending operation and ends of the horizontal grid bars can be overlapped and, for example welded together or secured in some other way. The outer shell can also, however, be assembled from a plurality of gridwork sections.

In the prior art transport and/or storage containers of this type, the pallet-forming structures are generally composed of wood. As a consequence they were formed from a material which may be considered a foreign body by comparison to the outer shell which is composed of steel in the above-described fashion. The outer shell has its bottom generally affixed to the surface.

Such operations are time-consuming and expensive so that the fabrication costs are high. Furthermore, the use of wood pallets beneath the enclosure of the gridwork has been found to detrimentally effect the form stability of the entire container and to increase the weight thereof.

A wood pallet has, moreover, a shorter useful life than the outer gridwork enclosure which means that the container must be rebuilt upon premature failure because of the early deterioration of the wood pallet.

For other purposes and in other contexts, pallets have been provided which can be manipulated by a forklift truck or the like and which are composed of metal. However, the existence of these metal pallet structures has not, to the best of our knowledge to date, had an effect on the manufacture and use of transport and/or storage containers of the type with which the present invention is concerned.

OBJECTS OF THE INVENTION

It is, therefore, the principal object of the present invention to provide an improved transport and storage container which, by comparison with the transport storage containers of the prior art, can be fabricated more simply and economically.

Another object of the invention is to provide an improved transport and/or storage container having an outer enclosure of a gridwork, a pallet for the forklift manipulation thereof, and an inner vessel of a plastic material in which the pallet is integrated more fully into the construction of the outer enclosure so that the form stability during transport and/or storage of the container is improved and the overall weight of the latter is reduced.

Still another object of the invention is to provide an improved transport and storage container whereby drawbacks of prior art units for the same purpose are overcome.

SUMMARY OF THE INVENTION

These objects and others which will become apparent hereinafter are attained, in accordance with the present invention, by a storage and/or transport containers of the type described, having an outer enclosure formed by a gridwork with horizontal and vertical bars crossing and connected to one another, a pallet and a lining or inner vessel of a synthetic resin material, wherein the pallet is constructed as a gridwork with crossing gridbars defining a gridlike bottom surface of the containers directly supporting the floor of the inner vessel.

According to the invention, at the edges of the bottom surface, the bars of the pallet gridwork are bent downwardly and define a supporting surface for the container on the ground which lies at a predetermined distance below the bottom surface, while the vertical grid bars of the outer enclosure, extend into the region of the supporting surface and are bonded or otherwise secured to a plurality, preferably all, of the downwardly bent bars of the pallet gridwork.

While the connection is preferably made by welding, it can be effected in other ways, e.g. via screw connectors or the like which can be of simple construction and can utilize simple assembly techniques.

According to a feature of the invention, the gridwork from which the pallet is formed and the gridwork from which the outer enclosure is formed are identical.

The gridworks preferably are composed of round steel rods or bars and, according to the invention, the outer enclosure can utilize vertical grid bars which generally have a greater diameter than the horizontal grid bars.

Similarly, the gridwork from which the pallet is constructed can have its grid bars extending in one direction of a larger diameter than the grid bars extending in the opposite direction orthogonal to one direction. On static grounds, it is preferable to have the grid bars cross orthogonally and to have the downwardly bent portions be steel-reinforcing mats for concrete or can be similar thereto.

In general terms, therefore, the container of the invention can comprise:

an outer support structure having at least one lateral wall and composed of a gridwork of interconnected vertical and horizontal bars;

a pallet-forming platform spanning the support structure, adapted to be engaged by a forklift truck or other stacking, lifting or shifting apparatus and having support surfaces on which the container can rest, the platform being composed of a gridwork of mutually crossing interconnected bars defining a bottom grid, the gridwork of the platform having downwardly bent portions supporting the bottom grid at a predetermined spacing above the surfaces, the vertical bars extending downwardly below the bottom grid substantially to a region of the surfaces and being connected to the portions; and an internal vessel of a plastic enclosed in the support structure and having flexible walls resting against and supported by the bottom grid and the lateral wall at least upon introduction of a flowable material into the vessel.

In a preferred embodiment of the invention, the transport and/or storage container has a rectangular or square plan configuration. This affords the possibility of arranging the downwardly bent grid bars of the pallet and the vertical grid bars of the outer enclosure which extend to the support surface so that they will lie directly adjacent one another and run parallel to one another.

This permits a weld connection between the adjacent bars of the pallet gridwork and the enclosure gridwork in the form of a V-type welding seam which is particularly stable and easy to form.

With the rectangular or square outline, moreover, the pallet can have an especially high stability when strengthening or stiffening shells or webs are set into the corners of the pallet and connected to the downwardly bent portions at these regions. Here too, the attachment of the reinforcing or stiffening shells with the downwardly bent portions of the pallet can be effected by welding screw connections or some other appropriate manner.

It has been found to be advantageous for proper placement of the container on the ground or on the floor to form the downwardly bent pallet grid bars extending below the bottom surface defined by the pallet with angle profiles which can be welded to these grid bars. The angle profiles of structural steel, thus form the feet of the pallet.

It is, however, also possible to provide the feet by further bending the downwardly bent bars of the pallet and the extension bars of the enclosure to form closed rings, rectangles or squares which can be closed by welding and form the feet directly.

The downwardly bent portions may be formed into such rings, rectangles or squares and/or the extensions of the vertical bars of the outer enclosure may be formed into the closed rings, rectangles or squares.

Depending upon the load characteristics to which the container may be subject, the bottom surface formed by the pallet can be provided with additional stiffening, e.g. by welding or otherwise connecting a stiffening rib centrally beneath the bottom surface.

This stiffening element may also be composed of a gridwork. e.g. a gridwork from which the pallet is formed or which is similar or identical to that gridwork. When especially high loads are to be applied to the container, the gridwork forming the enclosure and, if desired, the gridwork forming the pallet, or both can have at least one set of doubled support bars.

BRIEF DESCRIPTION OF THE DRAWINGS

The above objects, features and advantages of our invention will become more readily apparent from the following description, reference being made to the accompanying drawing in which.

SPECIFIC DESCRIPTION

Figure 1:
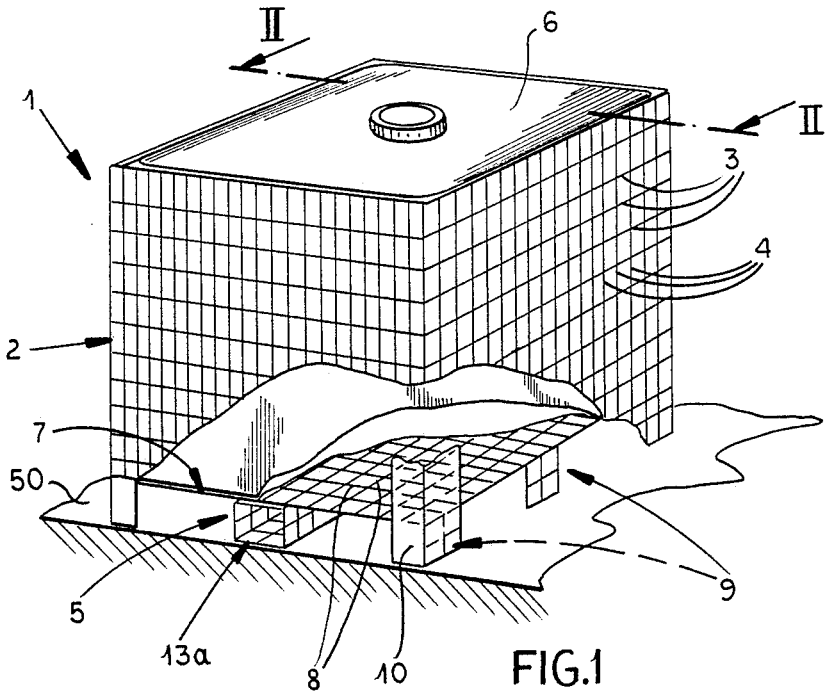
FIG. 1 is a partially broken away perspective view of a transport and/or storage container according to the invention.

FIG. 1 illustrates diagrammatically the principles of a transport and/or storage container in accordance with the invention, the container 1 is intended to hold liquids or finely divided bulk solids, i.e. a flowable material.

The container basically comprises an outer enclosure 2 which is composed of a gridwork with horizontal and vertical grid bars 3, 4 and can be seen to have vertical walls which laterally support the inner vessel 6. The lateral walls may be continuous with one another having been bent from a single piece of the gridwork formed by the horizontal and vertical grid bars 3 and 4 which can be interlaced, welded together by spot welds, or joined by deposit welds.

Below the outer enclosure 2, is a pallet 5 which forms the bottom surface upon which the inner vessel 6, for example formed by blow molding from thermoplastic synthetic resin can rest.

In order to enable the manipulation of the container 1, i.e. its movement about in a filled or empty state, its lifting and lowering and its transport or stacking, the pallet 5 is provided in a configuration enabling it to have a fork of a forklift truck introduced beneath the bottom surface of the pallet which is thereby held above the surface upon which the pallet 5 can rest as shown by cross-sectional hatching. The bottom surface of the pallet has been illustrated at 7 and the surface upon which the pallet rests is represented at 50.

According to the invention, the pallet is also formed as a gridwork with crossing arrays of mutually parallel grid bars 8. As a result, the bottom surface 7 has the configuration of a lattice or grate.

The pallet 5 is also formed with downwardly extending bends 9, constituted by downwardly bent portions of the bars 8, at the edges of the bottom surface 7 and, as shown at the corners of the container, to define a spacing a of the bottom surface 7 above the surface 50.

The vertical grid bars for of the outer enclosure are extended downwardly until they reach the standing surface 50 as well and are connected to the downwardly bent portions 9, e.g. by welding.

The connections can be made, depending upon the geometry of the gridwork, with all of the downwardly bent portions 9 or with only some of these downwardly bent portions.

If the gridwork from which the pallet 5 is formed and the gridwork constituting the outer enclosure 2 are identical, i.e. have bars of the same diameter (caliber) and spacing, it is no problem to provide every vertical grid bar 4 in the region of its lower extension adjacent a downwardly bent portion 9 of a grid bar 8 so that the adjacent bars can be welded together by a deep weld.

Preferably, the containers of the invention have a rectangular plan configuration or outline can, as shown be of generally square outline. As a consequence, the downwardly bent portions 9 and the vertical bars 4 can run parallel to one another so that they are side by side over the entire height a, for example, thereby facilitating the formation of deposit welds in the crevices defined by the adjoining round bars. As can be seen from FIG. 1, stiffening shells 10 can be welded in place at the corners of the pallet 5 to the downwardly bent portions 9. These shells 10 can be composed of steel sheet or plate.

Figure 2:
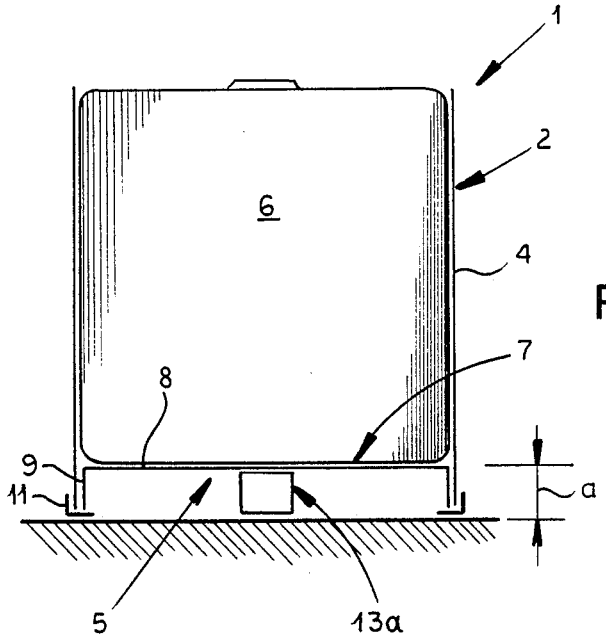
FIG. 2 is a section taken along the line II—II of FIG. 1.

From FIG. 2 it can be seen that the downwardly bent ends 9 of the bars 8 of the pallet 5 and the ends of the vertical bars 4 reach to and are welded to foot-forming profiles 11 which can be angle irons or steel angles.

Figure 3:
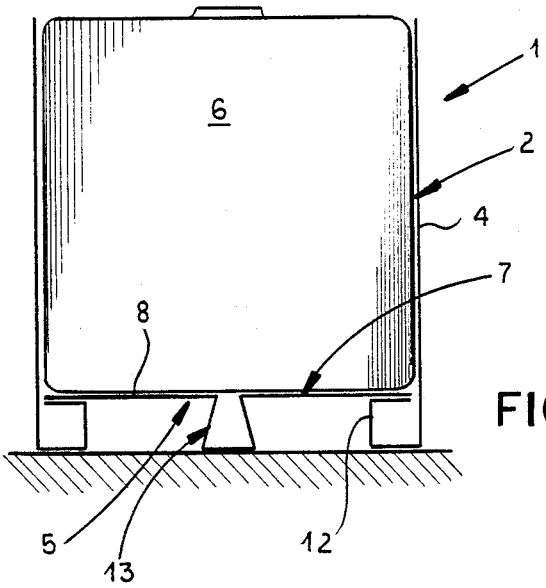
FIG. 3 is a view generally similar to FIG. 2 illustrating another embodiment.
Figure 4:
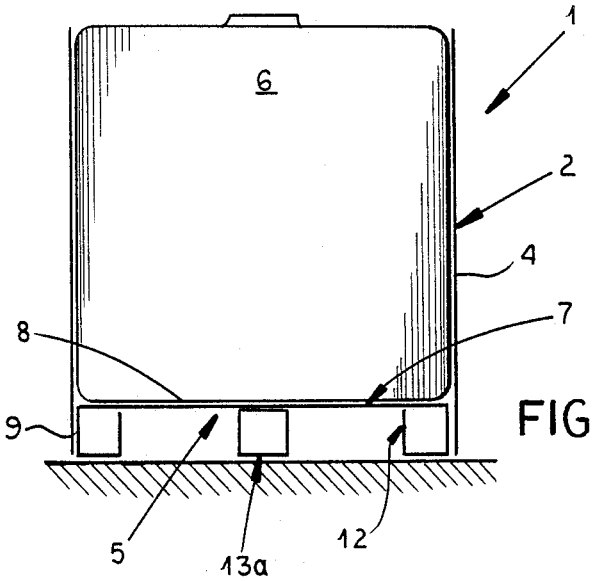
FIG. 4 is a view also generally similar to FIG. 2 illustrating still another embodiment.

In the embodiment of FIG. 3, however, the end portions of the vertical bars 4 of the enclosure 2 are bent to form closed rectangles or squares 12 forming the feet for the pallet in conjunction with a central reinforcing member 13, but downwardly from the bars 8 of the pallet. Central reinforcing members **13*a* are provided of gridwork as separate elements in FIGS. 1, 2 and 4 and can be welded to the bars forming the surfaces 7** to provide additional bracing for the pallet, if required.

Figure 5:
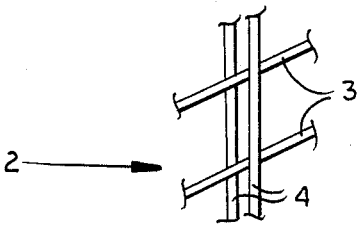
FIG. 5 is a perspective detail view of the pallet.

As can be seen from FIG. 5, the gridwork constituting the outer enclosure 2 can be composed of a double array of vertical bars 4 receiving the horizontal bars 3 between them.

Figure 6:
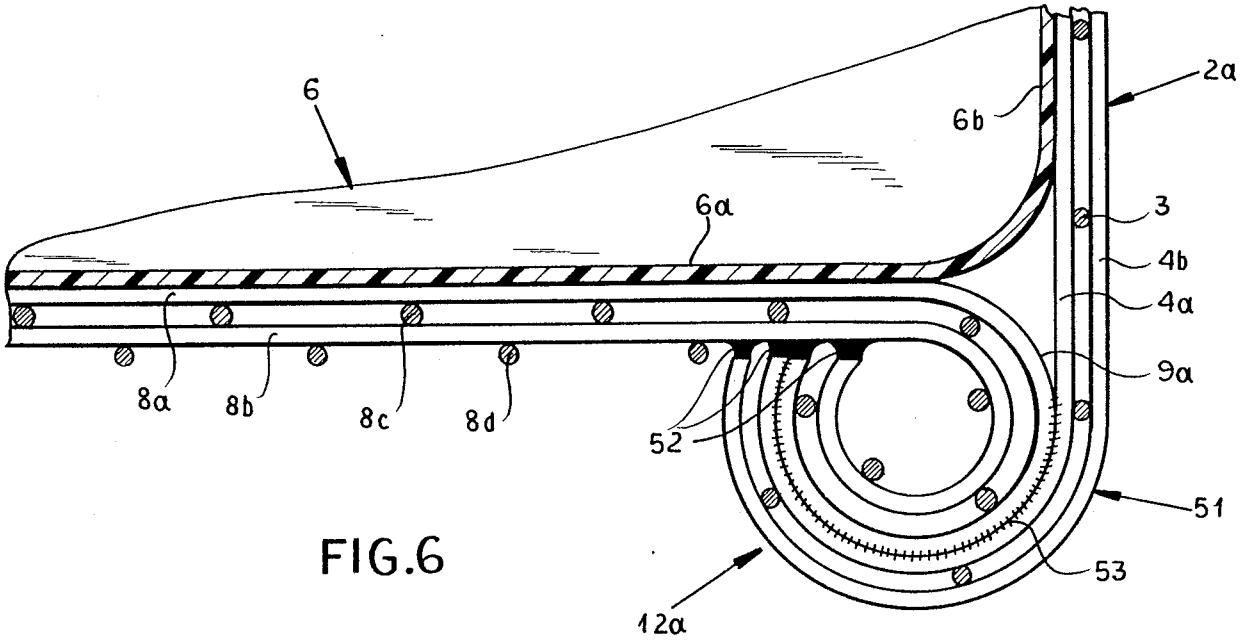
FIG. 6 is a cross-sectional view through the region at one corner of the enclosure and pallet of an embodiment of the invention utilizing the construction shown in FIG. 5 for the outer enclosure.

In FIG. 6, we have shown an embodiment in which the outer enclosure **2*a* is constituted by a gridwork having two vertical bars 4*a* and 4*b* receiving the horizontal bars 3 between them. The extensions 51 of the vertical bars are here rolled to form a foot 12*a* around the rolled downwardly bent portions 9*a*. The downwardly bent portions are formed from doubled bars 8*a* and 8*b* receiving bars 8*c* between them and a further layer of bars 8*d* can be formed on the outside of the gridwork forming the pallet. The foot, 12*a* is welded closed at 52 and a weld seam 53 between the adjacent bars of the pallet and the vertical enclosure can be seen at 53**.

The flexible walls **6*a* and 6*b*** of the inner enclosure can be seen to be supported by the gridworks.

Figure 7:
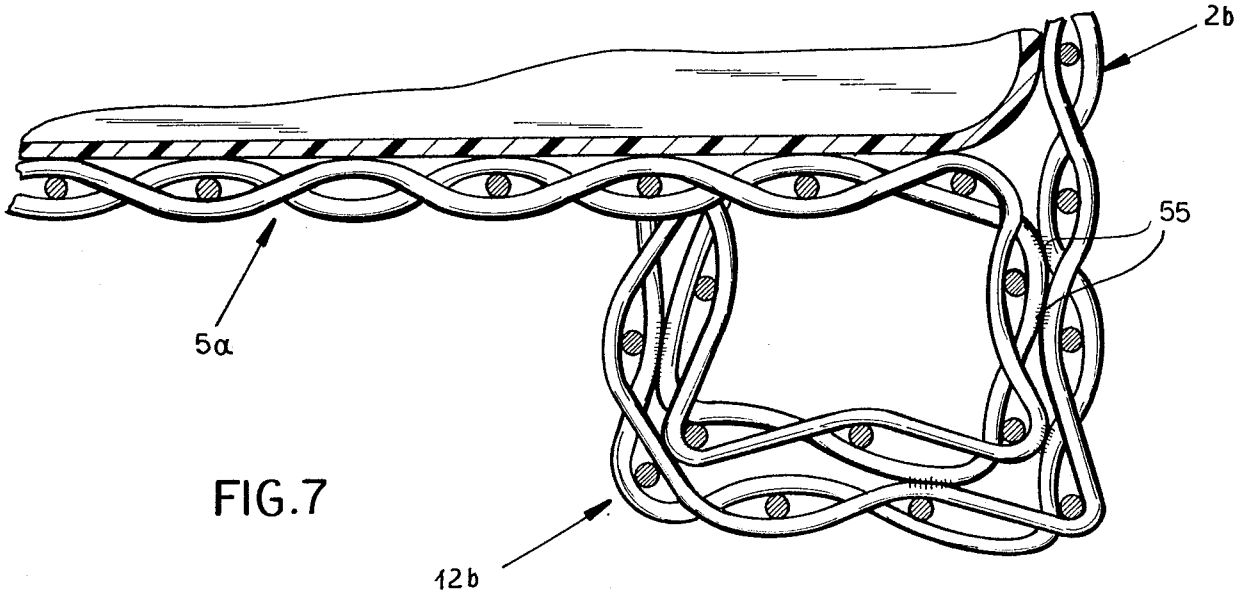
FIG. 7 is a view similar to FIG. 6 illustrating another embodiment.

In FIG. 7, we have shown an arrangement in which the pallet-forming bars are provided in a woven gridwork array as are the enclosure-forming bars **2*b*, in addition to being welded together, as in, for example, reinforcing mat for concrete or the like. Welds 55 which can join the bars together and here a rectangular section foot 12*b*** is formed by bending the downwardly bent portions and the extensions upwardly again.

We claim:

1. A transport and storage container for a flowable material, comprising:

an outer support structure having at least one lateral wall and composed of a gridwork of interconnected vertical and horizontal bars;

a pallet-forming platform spanning said support structure, adapted to be engaged by a forklift truck or other stacking, lifting or shifting apparatus and having support surfaces on which said container can rest, said platform being composed of a gridwork of mutually crossing interconnected bars defining a bottom grid, the gridwork of said platform having downwardly bent portions supporting said bottom grid at a predetermined spacing above said surfaces, said vertical bars extending downwardly below said bottom grid substantially to a region of said surfaces and being connected to said portions; and an internal vessel of a plastic enclosed in said support structure and having flexible walls resting against and supported by said bottom grid and said lateral wall at least upon introduction of a flowable material into said vessel.

2. The transport and storage container defined in claim 1 wherein said gridworks are substantially identical as to bar spacing and caliber.

3. The transport and storage container defined in claim 1 wherein at least one of said gridworks has a configuration of a steel concrete-reinforcing mat.

4. The transport and storage container defined in claim 3 wherein said gridworks are composed of steel concrete-reinforcing mats.

5. The transport and storage container defined in claim 1 wherein said outer support structure and said platform have a generally rectangular plan configuration, wherein said portions and said vertical bars are mutually parallel.

6. The transport and storage container defined in claim 5 wherein said portions are provided at corners of said platform, further comprising stiffening shells secured to said portions at said corners.

7. The transport and storage container defined in claim 1 wherein said outer support structure has a substantially square plan configuration.

8. The transport and storage container defined in claim 1, further comprising foot-forming profiles connected to said portions and defining said surfaces, said vertical bars being connected to said foot-forming profiles.

9. The transport and storage container defined in claim 1 wherein said portions are further bent to define substantially closed feet forming said surfaces.

10. The transport and storage container defined in claim 9 wherein said substantially closed feet are of ring shape.

11. The transport and storage container defined in claim 9 wherein said substantially closed feet are of rectangular shape.

12. The transport and storage container defined in claim 11 wherein said substantially closed feet are of square shape.

13. The transport and storage container defined in claim 9 wherein said vertical bars are further bent to define substantially closed feet forming said surfaces.

14. The transport and storage container defined in claim 13 wherein said substantially closed feet are of ring shape.

15. The transport and storage container defined in claim 13 wherein said substantially closed feet are of rectangular shape.

16. The transport and storage container defined in claim 15 wherein said substantially closed feet are of square shape.

17. The transport and storage container defined in claim 1, further comprising a stiffening element secured to said platform along an underside of said bottom grid substantially midway between opposite edges of said platform and consisting substantially of a gridwork of crossing bars.

18. The transport and storage container defined in claim 17 wherein the gridwork of said platform and the gridwork of said element have substantially the same bar spacing and caliber.

19. The transport and storage container defined in claim 1 wherein said gridwork of said outer support structure has two layers of vertical bars flanking a layer of horizontal bars.

20. The transport and storage container defined in claim 1 wherein said gridwork of said platform has two layers of mutually parallel bars forming said portions and flanking a layer of bars orthogonal to said mutually parallel bars.

* * * * *